US010914027B2

(12) United States Patent
Magnusson

(10) Patent No.: US 10,914,027 B2
(45) Date of Patent: Feb. 9, 2021

(54) COMBINED DETERGENT AND FILTER UNIT, AND A MACHINE CONFIGURED TO USE THE COMBINED UNIT

(71) Applicant: CleanGuard AB, Nacka Strand (SE)

(72) Inventor: Fredrik Magnusson, Saltsjö-Boo (SE)

(73) Assignee: CleanGuard AB, Nacka Strand (SE)

( * ) Notice: Subject to any disclaimer, the term of this patent is extended or adjusted under 35 U.S.C. 154(b) by 82 days.

(21) Appl. No.: 16/304,382

(22) PCT Filed: May 18, 2017

(86) PCT No.: PCT/SE2017/050527
§ 371 (c)(1),
(2) Date: Nov. 26, 2018

(87) PCT Pub. No.: WO2017/204725
PCT Pub. Date: Nov. 30, 2017

(65) Prior Publication Data

US 2019/0218703 A1 Jul. 18, 2019

(30) Foreign Application Priority Data

May 24, 2016 (SE) ..... 1650717

(51) Int. Cl.
*C11D 17/04* (2006.01)
*D06F 39/02* (2006.01)
*D06F 39/10* (2006.01)

(52) U.S. Cl.
CPC ..... *D06F 39/02* (2013.01); *D06F 39/10* (2013.01)

(58) Field of Classification Search
None
See application file for complete search history.

(56) References Cited

U.S. PATENT DOCUMENTS 3,757,543 A 9/1973 Braga
5,132,036 A 7/1992 Falou et al.
(Continued)

FOREIGN PATENT DOCUMENTS

CN 1118824 A 3/1996
CN 1131217 A 9/1996
(Continued)

OTHER PUBLICATIONS

Chinese Office Action with translation for corresponding Chinese Patent Application No. 201780032159.3 dated Jun. 30, 2020.
(Continued)

*Primary Examiner* — Lorna M Douyon
(74) *Attorney, Agent, or Firm* — Renner, Otto, Boisselle & Sklar, LLP

(57) ABSTRACT

A combined unit (2) for containing detergent or other chemical compounds, mainly for washing or dishwashing machines, the combined unit comprises at least one pocket (4) configured to contain at least one compound intended for at least one phase of a washing program. The combined unit comprises two sides, an inlet side (6) and an outlet side (8), and the sides of the unit (2) are intended for inlet and outlet liquid, respectively, into and out from the combined unit. The inlet side and said outlet side are constituted by liquid permeable filter members. In one embodiment the inlet side filter member is denser than the outlet side filter member, and that the inlet side filter member is capable of filtering out micro fibres in the inlet liquid. Also provided is a machine adapted to use the combined unit.

13 Claims, 3 Drawing Sheets

(56) References Cited

U.S. PATENT DOCUMENTS

| | | | | |
|---|---|---|---|---|
| 5,579,656 | A | 12/1996 | Shin | |
| 5,613,379 | A | 3/1997 | Kim | |
| 5,656,583 | A * | 8/1997 | West | A47J 31/60 510/439 |
| 2001/0031714 | A1 | 10/2001 | Gassenmeier | |
| 2010/0125046 | A1 | 5/2010 | Denome et al. | |
| 2010/0200025 | A1 | 8/2010 | Housmekerides et al. | |

FOREIGN PATENT DOCUMENTS

| | | | |
|---|---|---|---|
| EP | 2 633 113 | | 9/2013 |
| EP | 2 813 612 | | 12/2014 |
| GB | 2 187 748 | A | 9/1987 |
| WO | WO 96/26312 | | 8/1996 |
| WO | WO 97/01625 | A1 * | 1/1997 |
| WO | 02/26928 | A1 | 4/2002 |

OTHER PUBLICATIONS

International Search Report and Written Opinion for corresponding Patent Application No. PCT/SE2017/050527 dated Jun. 21, 2017.
Extended European Search Report for corresponding European Patent Application No. 17803168.8 dated Nov. 22, 2019.

* cited by examiner

COMBINED DETERGENT AND FILTER UNIT, AND A MACHINE CONFIGURED TO USE THE COMBINED UNIT

TECHNICAL FIELD

The present disclosure relates generally to washing or dishwashing machines and more particularly to a combined detergent and filter unit having at least one pocket including a washing detergent compound, and provided with filtering capabilities to filter the liquid prior, during, and after the washing procedure. The combined unit provides a combination of a controlled release of at least one detergent compound in the washing, dishwashing, cleaning, or after treatment process, and of filtration of liquid prior, during, and after washing.

BACKGROUND

For a long time it was the norm to provide the consumer with washing detergents in the form of bulk-packaged goods and to leave it up to the consumer at the time of use to dose the washing detergent in accordance with the requirements of the application, which depended on the water hardness, the nature, amount, and/or degree of soiling of the laundry, ware or article to be cleaned, on the amount of the washing or cleaning liquor, and on other parameters.

In view of the consumer's desire to have laundry detergents which are easier and more convenient to dose, these detergents were increasingly provided in a form which obviates the need for ad hoc dosing: washing detergents were formulated in predetermined portions comprising all of the components required for one washing or cleaning cycle or operation. In the case of solid products, such portions were frequently formed into shapes (sometimes comprising two or more phases) such as granules, beads, tablets ("tabs"), cubes, briquettes, etc., which are dosed as a whole into the liquor. Liquid products were placed in water-soluble enclosures which dissolve on contact with the aqueous liquor and release the contents into the liquor.

A disadvantage of these solutions is that all of the components required in the course of a wash or cleaning cycle or operation pass simultaneously into the aqueous liquor. In this case, not only are there problems of incompatibility of certain components of a washing detergent with other components, but also it becomes impossible deliberately to dose certain components into the liquor at a defined point in time.

The prior art has since described means by which individual laundry detergent components may be dosed deliberately and at a defined point in time during use. For example, the temperature controlled release of active substances is described, permitting active substances such as surfactants, bleaches, soil release polymers and the like to be released either in the main wash or cleaning cycle or operation or even in an after treatment cycle or operation—for example, in the rinse cycle in the case of machine dishwashing.

During laundry, irrespectively if it is performed conventionally or in a flexible washing compartment, two problems (among others) have been identified.

The first problem relates to that different types of stains and dirt are best removed at different temperatures and by using different active substances in the washing detergent. Washing cycles therefore often start at a low temperature that is successively increased to a set desired end temperature.

The washing detergent often comprises mixtures of different active substances to function (to be active) in different temperature ranges. One problem is that active substances may be rinsed away already in the first cold washing cycle.

One solution to this problem is to have different washing detergent containers in the washing machine for different active substances, e.g. one intended for prewash, one for the main washing program, and one for the rinsing agent.

The second problem relates to the existence of micro fiber in the sewage water is a problem.

The knowledge of the problems related to fibers in the sewage water is increasing rapidly. Probably there will soon be an EU directive including a requirement of fine filtered sewage water.

In the following some prior art documents in the technical field will be briefly discussed. The first two documents show that the aspect where the content of the respective container of a multi-container device, that are intended to be released at different phases of the washing program are well known.

US-2001/0031714 discloses a multi-pocketed detergent portion where the different chemicals are to be released at different phases/times of a washing program.

US-2010/0125046 discloses a multi-compartmented water-soluble pack comprising a cleaning composition.

WO-96/26312 discloses a receiving part of a washing machine including a piercing member for punctuating a detergent container.

EP-2813612 discloses a piercing member in the lid of the washing machine receiving container for punctuating a detergent container.

US-20100200025 discloses a cartridge receiving member of a washing machine.

The object of the present invention is to remove, or at least mitigate, the two problems discussed above. More specifically the object is to achieve a combined detergent and filter unit, and a machine for using the combined unit, that solve the problems both with regard to optimal use of washing detergent compounds, and with regard to effectively filter out micro fibers of the liquid.

SUMMARY

The above-mentioned object is achieved by the present invention according to the independent claim.

Preferred embodiments are set forth in the dependent claims.

The present invention relates to a combined detergent and filter unit containing detergent or other chemical compounds, mainly for washing or dishwashing machines. The combined unit comprises at least one pocket for a washing detergent intended for at least one phase of a washing program.

The combined unit comprises two sides, an inlet side and an outlet side. The sides of the unit is intended for inlet and outlet water and are constituted by filter members, where the inlet side filter preferably is denser than the outlet side to filter out micro fibers.

A unit receiving member is provided at a washing machine where the unit is to be used. The unit receiving member is configured to engage the combined unit so that different pockets, if the unit is a multi-pocket unit, are sealed from each other. This is achieved by providing the inner surfaces of the receiving member with a sealing structure to apply a pressure to the outer surface of the unit. During use, liquid is directed selectively to the respective pockets of the unit during different phases of the washing program.

By directing the washing water into an intended pocket provided with a specified washing detergent the washing result is optimized and also the use of various chemicals is minimized as the temperature of the washing water is taken into account when directing the washing water into the unit. Thus, no non-active surfactants (tensides) will be rinsed out during a part of the washing cycle when they are not active. In addition the water is continuously filtered both during active washing phases (detergent is used), and during other phases.

When the washing is finalized or at least before the next washing procedure, the unit is removed and discarded. No washing detergent is then left in the unit. The inlet side is then probably filled up with filtered out micro fibers.

By implementing the unit the distribution of the used chemicals, i.e. the washing detergent compounds, is optimized. In addition the filtration level of the liquid is considerably increased.

The combined unit is easy to insert into the machine which simplifies for the user as he/she only has to insert the unit and press the start button. Thus, it is not necessary to load the prewashing detergent, the main washing detergent, the rinsing media, separately.

A visual observation by the user of the unit at the fine filter member indicates the level of dirt and wear from one single washing procedure.

The combined unit disclosed herein is in particular applicable in the washing machine disclosed in EP-2633113 which washing machine is provided with a flexible washing compartment, therein denoted washing bag. In a washing machine of that kind there are high requirements with regard to prevent fibers or lumps of washing detergent compounds from entering the vacuum pump.

DETAILED DESCRIPTION

The combined unit, and the machine where the combined unit is applied, will now be described in detail with references to the appended figures. Throughout the figures the same, or similar, items have the same reference signs. Moreover, the items and the figures are not necessarily to scale, emphasis instead being placed upon illustrating the principles of the invention.

The invention relates to a combined unit 2 for containing detergent or other chemical compounds, mainly for washing or dishwashing machines. The washing detergent(s) may be provided in any available suitable shape or consistency; e.g. as powder, pellets, solid unit, or soaked in the fibers of the filter members.

Figure 4:
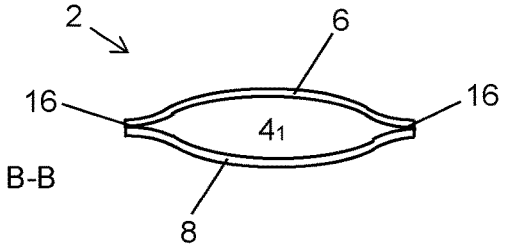
FIG. 4 is a cross-sectional view of the combined unit illustrated in FIG. 1 according to one variation, along A-A.
Figure 5:
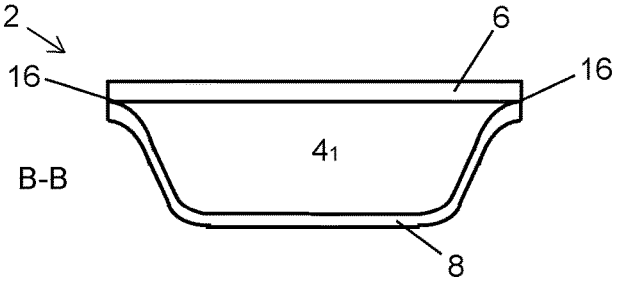
FIG. 5 is a cross-sectional view of the combined unit illustrated in FIG. 1 according to another variation, along B-B.
Figure 6:
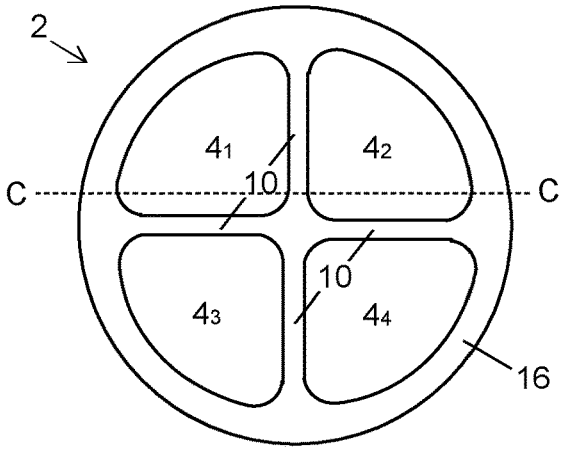
FIG. 6 is a schematic top view of a combined unit according to another embodiment of the invention.
Figure 7:
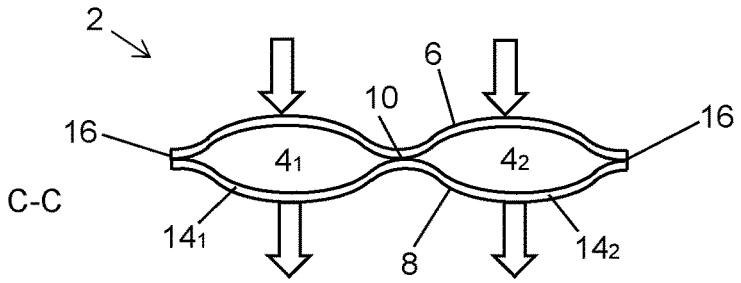
FIG. 7 is a cross-sectional view of the combined unit illustrated in FIG. 4 according to one variation, along C-C.
Figure 8:
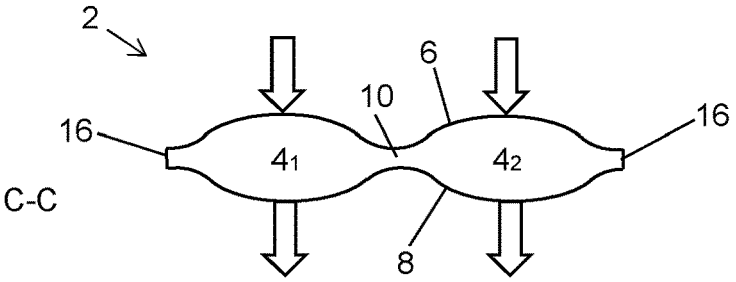
FIG. 8 is a cross-sectional view of a combined unit illustrating a further embodiment according to the present invention.

The combined unit will now be disclosed in detail with references to FIGS. 1-8, where FIGS. 1-5 illustrates one embodiment, and FIGS. 6-8 illustrates another embodiment of the combined unit. Preferably, the combined unit has a maximal extension of 5-10 cm, and a thickness of 0.5-3 cm.

The combined unit comprises at least one pocket 4 configured to contain at least one compound intended for at least one phase of a washing program. The embodiment illustrated in FIGS. 1-5 comprises three pockets $\mathbf{4}_1$, $\mathbf{4}_2$, and $\mathbf{4}_3$, and the embodiment illustrated in FIGS. 6-8 comprises four pockets $\mathbf{4}_1$, $\mathbf{4}_2$, $\mathbf{4}_3$, and $\mathbf{4}_4$.

The combined unit comprises two sides, an inlet side 6 and an outlet side 8, and the sides of the unit 2 are intended for inlet and outlet liquid, respectively, into and out from the combined unit.

The inlet side and the outlet side are constituted by liquid permeable filter members, which preferably are structured such that the inlet side filter member is denser than the outlet side filter member, and that the inlet side filter member is capable of filtering out micro fibers in the inlet liquid.

In embodiments where the unit comprises more than one pocket, the pockets 4, are separated from each other by separating pocket walls 10 that connects an inner surface of the inlet side filter member with the inner surface of the outlet side filter member, and wherein the separating pocket walls are made from a liquid impermeable material.

Preferably the combined unit 2 comprises 1-5 separate pockets 4. However, the number of pockets is naturally dependent upon the actual implementation, and within the scope of the invention as defined by the appended claims also a higher number of pockets is possible.

In some washing programs it may be advantageous to use one or many of the pockets of the combined unit only for liquid filtering purposes. In such cases at least one pocket 4 is empty, i.e. it does not contain any washing detergent compound, and the liquid is allowed to pass through the pocket in order to filter out micro particles in the input liquid flow. Micro particles are normally regarded as being particles between 0.1 and 100 μm in size. Micro particles encountered in daily life include pollen, sand, dust, flour, and powdered sugar.

In one embodiment the entire inlet side filter member has the same filter capability, denoted first filter characteristics, and having a first material density. Some filters use more than one filtration method. An example of this is a multi-barrier system, e.g. filters comprising various layers of filters. The inlet side filter member preferably comprises a woven or nonwoven fine filter, and may comprise fine meshes.

Figure 1:
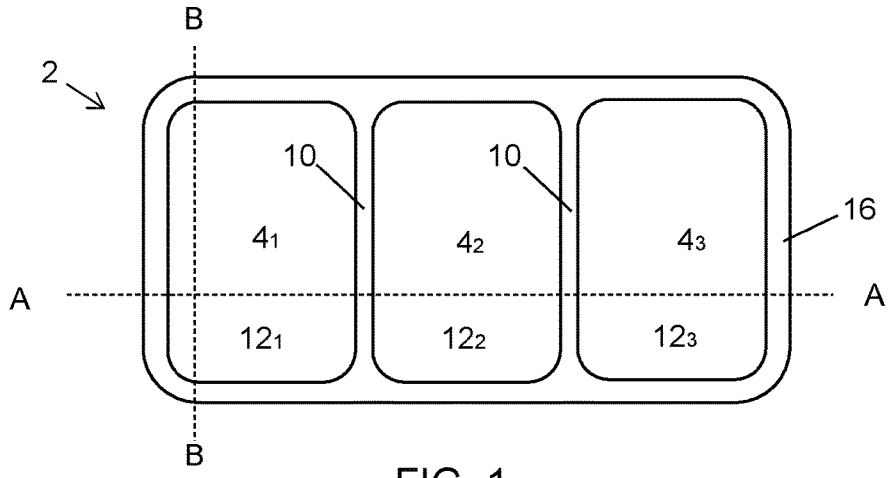
FIG. 1 is a schematic top view of a combined unit according to one embodiment of the invention.

As an alternative the inlet side filter member is divided into a number of different inlet filter member parts 12 where at least two having different filter capabilities, and wherein each filter member part is arranged for filtering inlet liquid for one pocket 4. In FIG. 1 is illustrated one example where the three pockets are provided with inlet filter member parts $\mathbf{12}_1$, $\mathbf{12}_2$, and $\mathbf{12}_3$, respectively having different filter capabilities.

The outlet side filter member comprises a woven or nonwoven un-meshed filter structured to prevent undissolved washing detergent compounds, e.g. washing powder, from escaping from the combined unit with the outlet liquid flow.

Preferably, the entire outlet side filter member has the same filter capability, denoted second filter characteristics, and having a second material density.

Figure 2:
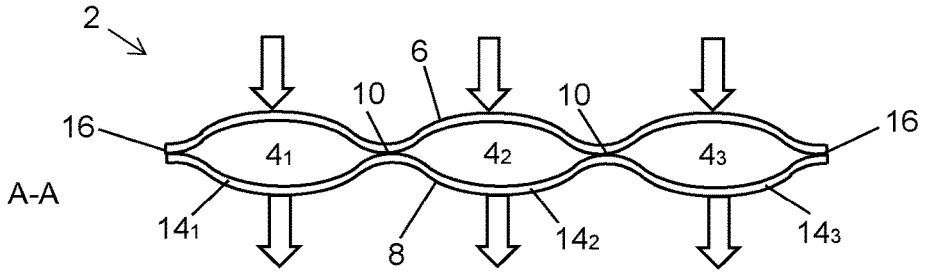
FIG. 2 is a cross-sectional view of the combined unit illustrated in FIG. 1 according to one variation, along A-A.

As for the inlet side, also the outlet side filter member may be divided into a number of different outlet filter member parts 14, where at least two having different filter capabilities, and wherein each filter member part is arranged for filtering outlet liquid from one pocket. These are indicated in FIG. 2 and denoted as $\mathbf{14}_1$, $\mathbf{14}_2$, and $\mathbf{14}_3$.

Thus, the unit may include various types of detergent compounds in its pockets. Furthermore, some of the pockets may be empty and instead used during rinsing procedures and those empty pockets may be provided with filter member parts having different filter capabilities, e.g. a more coarse filtration in early rinsing procedures and finer filtration in later rinsing procedures.

Generally, the inlet side filter member is denser than the outlet side filter member. Thereby the liquid is filtered through the inlet side filter member before washing detergent is solved in the liquid. In addition it is prevented that the pressure inside the unit increases resulting in that the unit expands in an unwanted way.

The combined unit is provided with a sealing edge 16 configured to attach the inlet side 6 to the outlet side 8, and also configured to serve as a sealing when the unit is mounted in a unit receiving member 18 of a washing machine 20 such that liquid is forced to pass through the unit, via the filter members. The sealing edge is embodied by e.g. heat bonding or gluing.

The combined unit may have various external shapes dependent upon the actual application. Two different geometrical shapes are schematically illustrated herein, one where the unit approximately has a geometrical shape of a cuboid or one or many cushions (see FIGS. 1-5) and one of a cylinder having a circular cross-section (see FIGS. 6-8).

One preferred variation is illustrated in FIGS. 2 and 4 which are cross-sectional views along A-A and B-B in FIG. 1, respectively. In this embodiment each pocket essentially has a cushion-like shape which is defined by a sealing connection, which is embodied by at least one separating wall 10 and a sealing edge 16, between the inlet side filter member and the outlet side filter member. The sealing connection is preferably achieved by applying a pressure from both sides to the two filter members to press them together at the locations of the separating walls and sealing edges, in combination by applying a water-insoluble adhesive at those locations to achieve a water-tight seal between the pockets.

Figure 3:
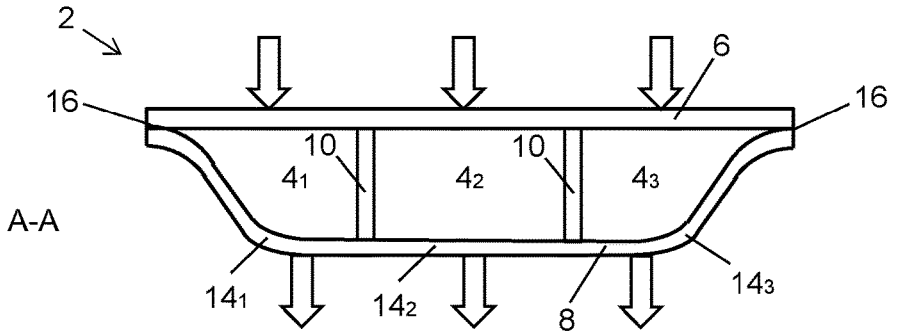
FIG. 3 is a cross-sectional view of the combined unit illustrated in FIG. 1 according to another variation, along B-B.

In the variation illustrated in FIGS. 3 and 5 which are cross-sectional views along A-A and B-B in FIG. 1, respectively, the unit comprises separating walls 10 having an extension in an essentially perpendicular direction in relation to the inlet and outlet side filter members. The separating walls are then made from a liquid impermeable material In FIG. 6 a top view of a combined unit having a circular shape is illustrated. Two different variation of this embodiment is illustrated in FIGS. 7 and 8, which are cross-sectional views along C-C in FIG. 6.

The variation shown in FIG. 7 is similar to the variation illustrated in FIGS. 2 and 4 with regard to that the pockets have an essentially cushionlike geometrical shape and also how the filter members are connected to each other.

Figure 9:
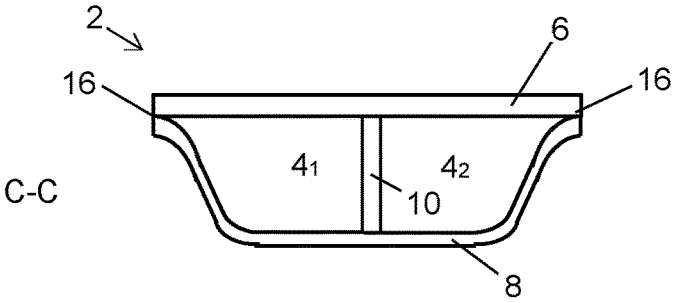
FIG. 9 is a cross-sectional view of the combined unit illustrated in FIG. 4 according to a second variation, along C-C.

The variation shown in FIG. 9 is similar to the variation illustrated in FIGS. 3 and 5.

The combined unit is preferably made from environmentally acceptable material(s) that may be recycled, e.g. various textile fiber materials, cellulose-based materials, etc.

In one further embodiment of the combined unit at least one of the pockets is at least partly filled with a filling structure. The filling structure may have a combined function, i.e. it is configured to perform filtration of the inlet liquid and to contain detergent or other chemical compound (s). The filling structure may then be soaked with a detergent. Preferably the filling structure is constituted by one or both of the inlet side filter member and outlet side filter member. In that case the filter member(s) have a three-dimensional shape in order to fill up the pocket, and has a somewhat fluffy or spongy structure. In one variation the filling structure constitutes both the inlet and outlet side filter member. In one particular embodiment the filling structure fills up the entire pocket and constitutes both the inlet side filter member and the outlet side filter member. This embodiment is schematically illustrated in FIG. 8 where the filling structure fills up the entire pockets $\mathbf{4}_1$, $\mathbf{4}_2$. This feature is applicable to all embodiments of the combined unit.

Figure 10:
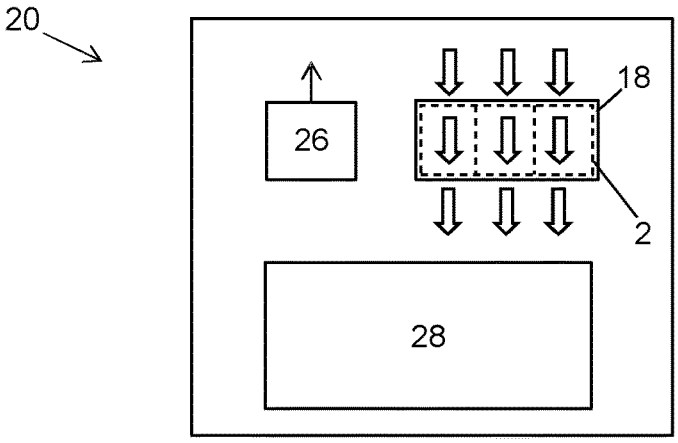
FIG. 10 is block diagram schematically illustrating a washing machine comprising a unit receiving member according to the present invention.

The invention also relates to a machine 20 comprising a washing unit 28 and a unit receiving member 18 configured to receive a combined unit 2 of the type described above. The machine 20 may be a washing machine or a dishwashing machine, or any other type of machine adapted to receive the combined unit. The machine and the unit receiving member will now be described with references to FIGS. 10-12. In those figures liquid flow is schematically indicated by arrows.

The unit receiving member comprises a sealing structure 22 (see FIGS. 11 and 12) provided at inner surfaces of the receiving member, and that the sealing structure is configured, when combined unit 2 is loaded into the receiving member, to engage the combined unit by applying a pressure on the inlet and outlet sides of the combined unit 2, such that the different pockets 4 are effectively liquid sealed from each other. The sealing structure is preferably made from an elastic material.

The sealing structure 22 is positioned at the inner surfaces of the unit receiving member 18 such that it essentially matches the positions at the outer surface of the combined unit of the separating pocket walls 10 and the sealing edge 16. Generally, the unit receiving member 18 has an inner shape that is adapted to the external shape of the unit.

Figure 11:
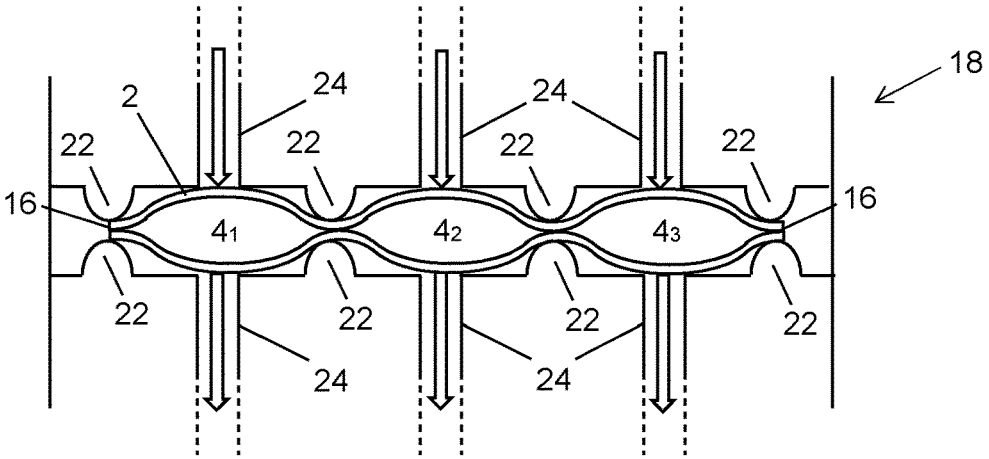
FIG. 11 is a cross-sectional view of the unit receiving member and the combined unit according to one embodiment.
Figure 12:
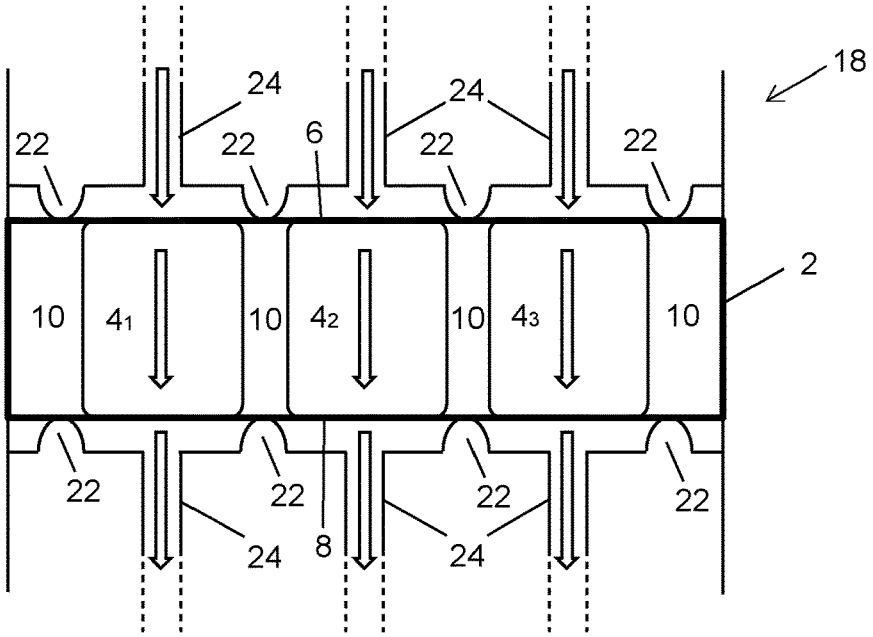
FIG. 12 is a cross-sectional view of the unit receiving member and the combined unit according to another embodiment.

Furthermore, the unit receiving member 18 is connected to a number of liquid tubes 24 configured to supply liquid to the unit, and to receive liquid from the unit. The liquid tubes are connected to the receiving member such that at least one sealed pocket 4 will be connected to at least one of the liquid tubes 24. In FIGS. 11 and 12 are illustrated one variation where one liquid tube for inflow liquid is connected to each inlet side of each pocket, and one liquid tube for outflow liquid is connected to each outlet side of each pocket.

FIG. 11 illustrates the variation of the combined unit described above with references to FIGS. 2 and 4 inserted and held in the unit receiving member 18.

And FIG. 12 illustrates the variation of the combined unit described above with references to FIGS. 3 and 5 inserted and held in the unit receiving member 18.

The washing machine is provided with a control unit 26 which is configured to generally control the washing machine, and in particular to control the supply and removal of liquid to and from the unit according to a washing program. The washing program includes a washing procedure that includes instructions to control the liquid supply to each of the pockets with regard to temperature, timing, liquid volume, etc., such that liquid is directed selectively to the respective pockets 4 of the unit during different phases of the washing program.

As discussed above the unit receiving member, and also the unit, may have various shapes. The unit receiving member is provided with a unit holding part that, when the unit is inserted and in an intended position, is activated to firmly hold the unit in the intended position. One important aspect is that when the unit is inserted into the receiving member and held in the intended position ("ready-position") the different pockets are sealed and insulated from each other. That is achieved by providing the sealing structure at the inner surfaces of the unit receiving member that matches the positions at the outer surfaces of the respective filter members of the separating pocket walls of the unit. When the unit is in the intended position the sealing structure is pressed against the outer surface of the unit resulting in that the different pockets inside the unit is effectively liquid sealed from each other.

When the washing procedure is concluded the unit receiving member may be opened the unit is easily removed and may be discarded.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A combined detergent and filter unit comprising at least one pocket configured to contain detergent or other chemical compound(s) intended for at least one phase of a washing program, and that the combined unit comprises two sides, an inlet side and an outlet side, and the sides of the unit are intended for inlet and outlet liquid, respectively, into and out from the combined unit, wherein said inlet side and said outlet side are constituted by liquid permeable filter members, an inlet side filter member and an outlet side filter member, respectively; and wherein at least one of the at least one pocket is devoid of a washing detergent compound.

2. The combined unit according to claim 1, wherein the inlet side filter member is denser than the outlet side filter member, and that the inlet side filter member is capable of filtering out micro fibers in the inlet liquid.

3. The combined unit according to claim 1, wherein the combined unit comprises 2-5 separate pockets.

4. The combined unit according to claim 1, wherein said pockets are separated from each other by separating pocket walls that connects an inner surface of the inlet side filter member with the inner surface of the outlet side filter member, and wherein the separating pocket walls are made from a liquid impermeable material.

5. The combined unit according to claim 1, wherein said inlet side filter member comprises a woven or nonwoven fine filter.

6. The combined unit according to claim 1, wherein the entire inlet side filter member has the same filter capability.

7. The combined unit according to claim 1, wherein said outlet side filter member comprises a woven or nonwoven coarse-meshed filter structured to prevent undissolved washing detergent compounds from escaping from the combined unit with the outlet liquid flow.

8. The combined unit according to claim 1, wherein the entire outlet side filter member has the same filter capability.

9. The combined unit according to claim 1, wherein the combined unit is provided with a sealing edge configured to attach the inlet side to the outlet side, and configured to serve as a sealing when the unit is mounted in a unit receiving member of a washing machine such that liquid is forced to pass through the unit, via the filter members.

10. The combined unit according to claim 1, wherein each pocket essentially has a cushion-like shape which is defined by a sealing connection, being embodied by at least one separating wall and a sealing edge, between said inlet side filter member and said outlet side filter member.

11. The combined unit according to claim 1, wherein the unit approximately has a geometrical shape of a cylinder having a circular cross-section, or of a cuboid.

12. The combined unit according to claim 1, wherein at least one of said pockets is at least partly filled with a filling structure, and wherein said filling structure is configured to perform filtration of said inlet liquid and/or to contain detergent or other chemical compound(s).

13. The combined unit according to claim 12, wherein said filling structure is constituted by one or both of said inlet side filter member and outlet side filter member.

* * * * *